US005361999A

United States Patent [19]

Sakato et al.

[11] Patent Number: 5,361,999

[45] Date of Patent: Nov. 8, 1994

[54] CRUSHER HAVING A STATIONARY JAW BODY AND A MOVABLE JAW BODY

[75] Inventors: Seiichi Sakato; Yukio Yamashita; Chikai Fujitaka; Kunihiko Matsui; Isamu Nagayoshi; Tadahiko Nagase; Hiroo Koyanagi; Yuuji Nagasawa, all of Chiba, Japan

[73] Assignee: Kabushiki Kaisha Sakato Kosakusho, Chiba, Japan

[21] Appl. No.: 74,433

[22] Filed: Jun. 9, 1993

[30] Foreign Application Priority Data

Jul. 7, 1992 [JP] Japan ..... 4-201876

[51] Int. Cl.[5] ..... B02C 1/04; B02C 1/10

[52] U.S. Cl. ..... 241/101.7; 241/266; 241/300

[58] Field of Search ..... 241/101.7, 266, 300

[56] References Cited

U.S. PATENT DOCUMENTS

| | | | |
|---|---|---|---|
| 2,851,225 | 9/1958 | McMahan | 241/300 |
| 4,347,988 | 9/1982 | Warren et al. | 241/300 |
| 4,776,524 | 10/1988 | Sakato | 241/101.7 |
| 4,899,942 | 2/1990 | Böhringer | 241/266 X |
| 4,934,616 | 6/1990 | Zepf | 241/101.7 X |
| 4,951,886 | 8/1990 | Berto | 241/300 X |
| 4,961,543 | 10/1990 | Sakato et al. | 241/101.7 |
| 5,004,168 | 4/1991 | Purser | 241/101.7 |
| 5,044,569 | 9/1991 | LaBounty et al. | 241/101.7 X |
| 5,183,216 | 2/1993 | Wack | 241/101.7 |
| 5,187,868 | 2/1993 | Hall | 241/101.7 X |

FOREIGN PATENT DOCUMENTS

| | | | |
|---|---|---|---|
| 280350 | 7/1990 | Germany | 241/266 |
| 2234452 | 6/1993 | United Kingdom . | |

*Primary Examiner*—Timothy V. Eley

*Attorney, Agent, or Firm*—Lowe, Price, LeBlanc & Becker

[57] ABSTRACT

A crusher-is disposed at a distal end of an operating boom of a construction vehicle. The crusher permits the breaking of a crushed mass of natural stone by means of a breaking force occurring between a stationary jaw body and a movable jaw body as the movable jaw body is closed toward the stationary jaw body. A flat auxiliary member is replaceably disposed on the stationary jaw body opposing the movable jaw body so as to break the crushed mass into smaller pieces. The distal end of the stationary jaw body projects longer than the distal end of the movable jaw body to facilitate the raking out of the crushed masses obtained in a blasting operation.

16 Claims, 11 Drawing Sheets

CRUSHER HAVING A STATIONARY JAW BODY AND A MOVABLE JAW BODY

BACKGROUND OF THE INVENTION

1. Field of the Invention

The present invention relates to a crusher capable of breaking crushed masses of natural stone or the like efficiently and safely.

2. Description of the Related Art

At quarrying sites, a plurality of holes are drilled in a rock surface for embedding explosives such as dynamite therein, the explosives such as dynamite are embedded in the holes, and the rock is detonated to obtain a multiplicity of crushed masses W of natural stone (see FIGS. 18 and 19). A breaker C is generally used to break the crushed mass W of natural stone into smaller pieces.

The breaker C is mounted at a distal end of an operating boom of a construction vehicle, and by operating the operating boom, the breaker C is brought into contact with the crushed mass W to perform the breaking operation. One crushed mass W at a time is raked out from a big pile of crushed masses W of natural stone and is moved to a flat ground surface or the like. The crushed mass W is set in a stable state suitable for breaking to facilitate the use of the breaker C, and the crushed mass W is broken into a multiplicity of small masses w by the breaker C.

When one crushed mass W at a time is raked out from the pile of crushed masses W, an attachment suitable for raking out the crushed masses w is mounted on the operating boom of another construction vehicle to take out the crushed masses W. Hence, a plurality of construction vehicles including the one equipped with the breaker C are required.

In addition, when the crushed mass W is broken with the breaker C, as shown in FIG. 18, it is necessary to set a chisel c of the breaker C perpendicular to the surface of the crushed mass W. In this manner the crushed mass W is broken into the small masses w by the breaker C.

During the operation of breaking the crushed mass W, there are cases where as the chisel c penetrates the crushed mass W, the direction of the chisel c becomes inevitably offset, or the position of the crushed mass W changes due to the vibration, impact, and the like of the breaker C, causing the direction of percussion of the chisel c of the breaker C to become offset. Accordingly, it is necessary for an operator to constantly correct the direction of the chisel c of the breaker C during the breaking operation.

Furthermore, since the chisel c needs to strike while applying an appropriate load, there is a drawback in that the operation of striking in the horizontal or upward direction cannot be performed in practice.

In the operation in which the rock is detonated with explosives such as dynamite and the multiplicity of crushed masses W in a pile are broken with the breaker C, it is impossible to break the crushed masses W as piled with the breaker C, since the stability of the crushed masses W is very poor.

For this reason, as shown in FIGS. 16 and 17, one crushed mass W at a time is first taken out and raked out from the pile of crushed masses W, and is then moved to a stable flat ground surface or the like. After the crushed mass W is set on that flat ground in a most stable state, the operation of breaking the crushed mass W is effected by means of the breaker C.

To take out the crushed masses W one by one from the pipe, a construction vehicle in which an attachment suitable for raking out the crushed masses W is mounted on its operating boom is required separately from the construction vehicle with the breaker C mounted thereon, as described above. Thus, it is necessary to prepare a plurality of construction vehicles and to deliver them to the site. In addition, a plurality of personnel are required for operating the breaker C and for raking out the crushed masses W. Hence, there are problems in that the cost increases and a long operating time is required.

As described above, in the breaking of the crushed masses W with the breaker C, as shown in FIG. 18, the breaking operation must be performed with the chisel c of the breaker C brought into contact with the crushed mass W perpendicular to the surface thereof. When this operating condition is not met, the crushed mass W cannot be broken efficiently, and it is necessary to make repeated attempts to break the crushed mass W. Hence, a longer operating time is required, thereby increasing the amount of burden imposed upon the operator.

Furthermore, when the crushed mass W is broken, if the condition in which the crushed mass W is set is poor or becomes unstable, the angle at which the chisel c of the breaker C strikes against the crushed mass W deviates from an allowable range, so that the chisel c of the breaker C fails to be brought into contact with the crushed mass W properly. As a result, there are cases where the chisel c strikes at the air, and in a worst case the breaker C may be damaged by the impact exerted by itself, making the breaking operation impossible.

To satisfactorily break the crushed mass W with the breaker C, it is necessary to constantly set the chisel c of the breaker C perpendicular to the surface of the crushed mass W to be broken. In addition, even if the chisel c of the breaker C is at a proper position with respect to the crushed mass W at the time of starting the breaking operation, there are cases where the crushed mass W moves due to the vibration and impact of the breaker C during the breaking operation, and the chisel c is set in an improper state with respect to the crushed mass W. Hence, it is necessary for the operator to constantly confirm the situation during the breaking operation, so that the operation of the breaker C has been difficult and troublesome, and a trained operator has been required for that purpose.

In addition, as shown in FIG. 19, since the force for crushing the crushed mass W is derived from the impact force of the chisel c of the breaker C, the following problems have been encountered: The lives of the breaker and the construction vehicle are extremely short, the scattering of the multiplicity of small masses w to a fairly large area presents an extreme danger to the operator, and large noise is produced when the crushed mass W is crushed by the breaker C.

SUMMARY OF THE INVENTION

Accordingly, it is an object of the present invention to provide a crusher capable of improving the efficiency in the operation of breaking crushed masses of natural stone or the like and performing the breaking operation safely, thereby overcoming the above-described drawbacks of the conventional art.

To this end, in accordance with one aspect of the present invention, there is provided a crusher in which a stationary jaw body and a movable jaw body are disposed at a distal end of an operating boom of a construction vehicle so as to break crushed masses of natural stone or the like through an opening and closing operation of the movable jaw body with respect to the stationary jaw body, comprising: an auxiliary member disposed on the stationary jaw body in face-to-face relation with the movable jaw body, a surface of the auxiliary member opposing the movable jaw body being formed with a flat surface.

The above and other objects, features and advantages of the present invention will become more apparent from the following detailed description of the invention when read in conjunction with the accompanying drawings.

DESCRIPTION OF THE PREFERRED EMBODIMENTS

Referring now to the accompanying drawings, a description will be given of the embodiments of the present invention. As shown in FIGS. 1 to 4, in a system for breaking crushed masses of natural stone in this embodiment, rock which is crushable is detonated with explosives such as dynamite to form a multiplicity of crushed masses W of natural stone. A construction vehicle M in which a crusher A is mounted at the distal end of an operating boom b is prepared. By means of the crusher A, the crushed masses W of natural stone are raked out from a big pile of crushed masses W, and are further crushed into smaller masses w.

Figure 1:
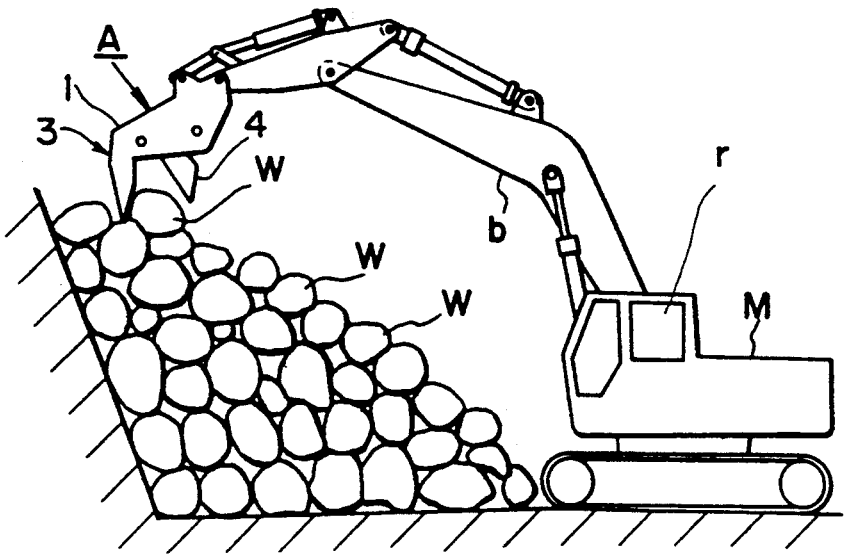
FIG. 1 is a schematic diagram illustrating a state in which a crushed mass of natural stone is being taken out from a pile oil crushed masses of natural stone.
Figure 2:
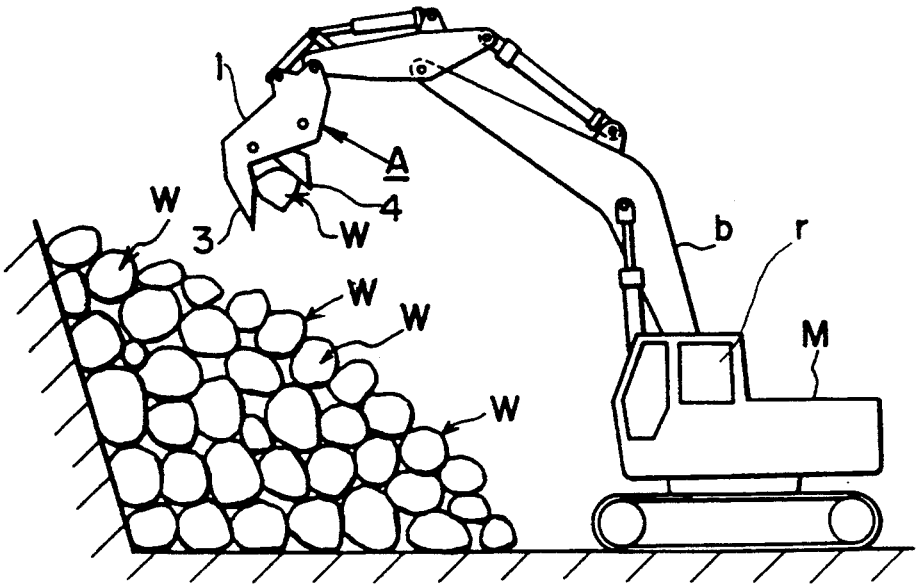
FIG. 2 is a schematic diagram illustrating a state in which the crushed mass of natural stone has been taken out from the pile of crushed masses.
Figure 3:
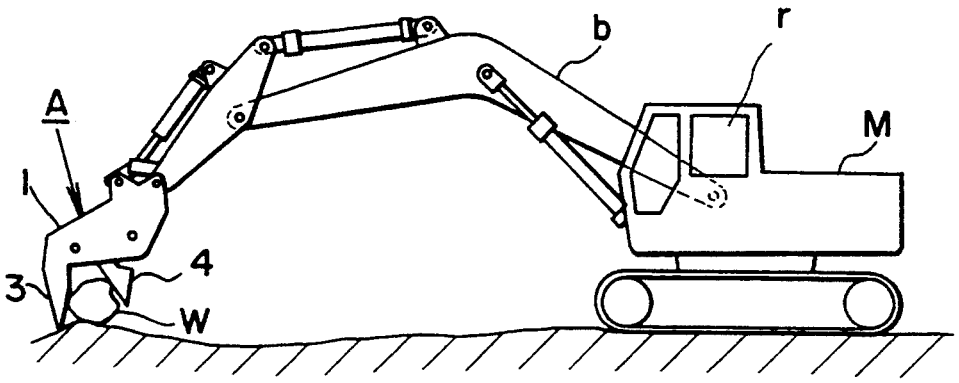
FIG. 3 is a schematic diagram illustrating a state in which the crushed mass of natural stone is about to be broken.
Figure 4:
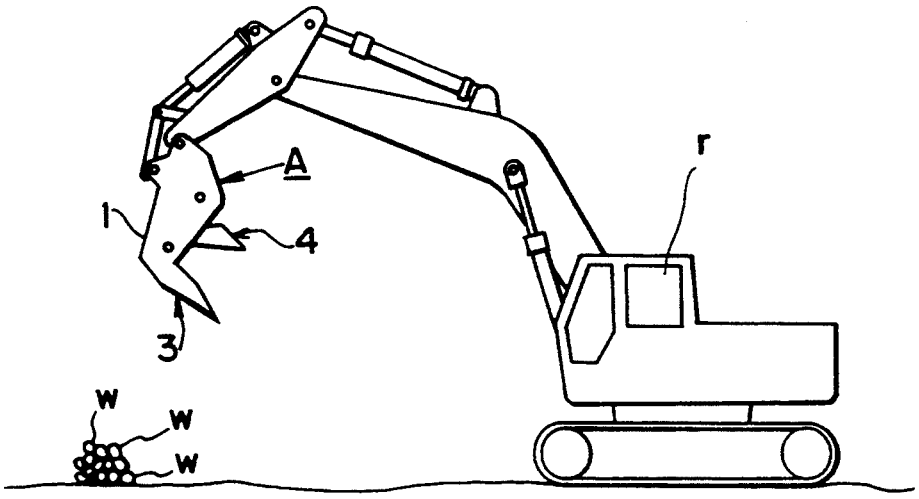
FIG. 4 is a schematic diagram illustrating a state in which the crushed mass is broken into a plurality of small masses.
Figure 5:
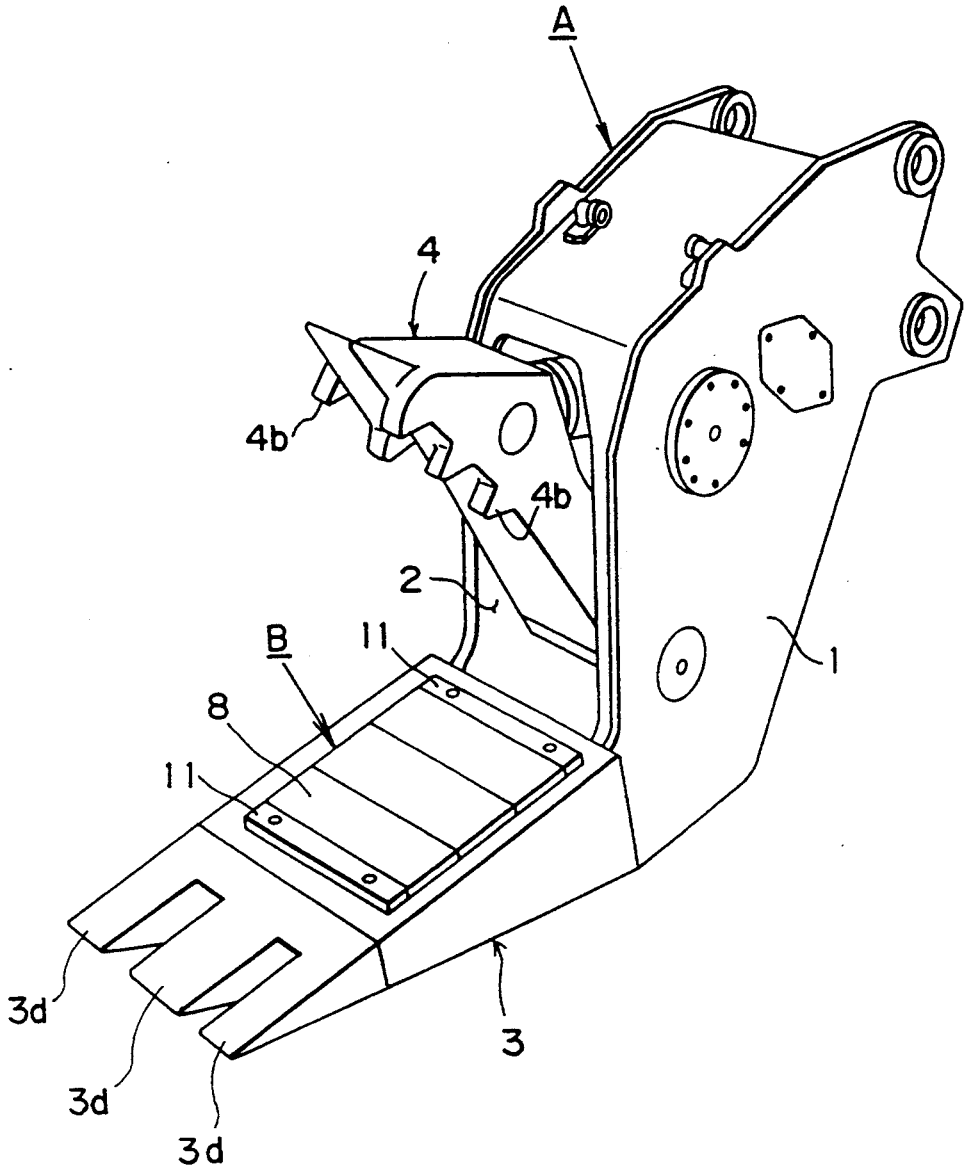
FIG. 5 is a perspective view of an embodiment of a crusher in accordance with the present invention.
Figure 6:
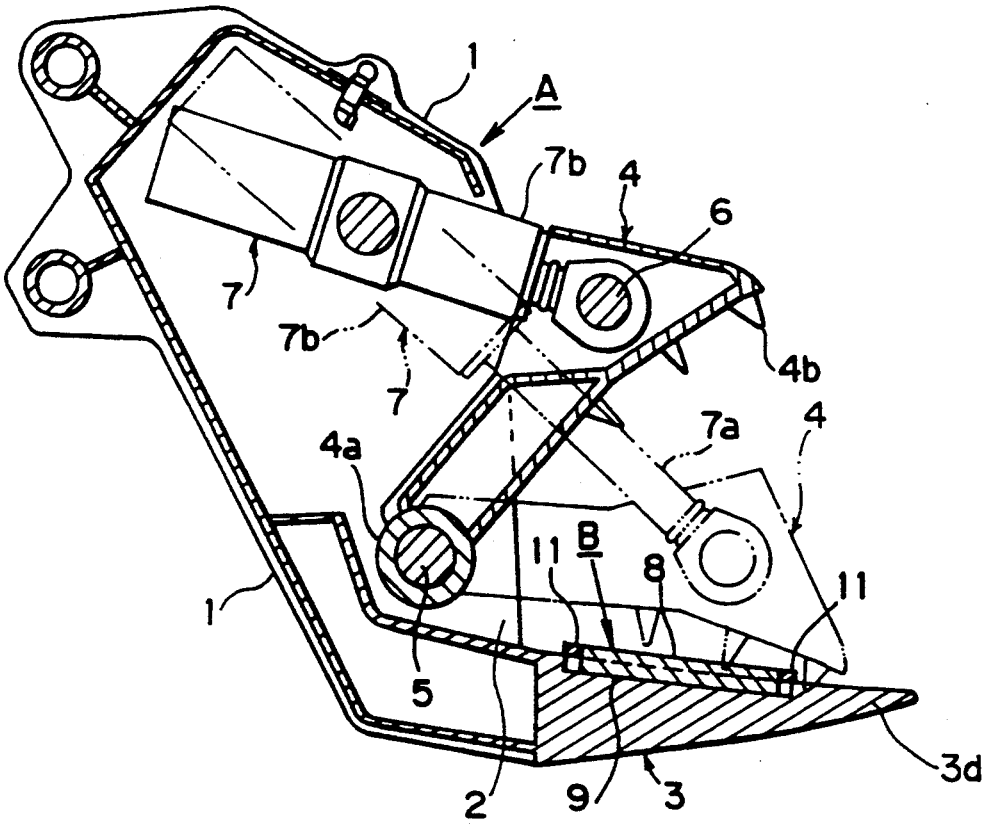
FIG. 6 is a cross-sectional view of the crusher.

As shown in FIGS. 5 and 6, the crusher A is comprised of a crusher body 1, a stationary jaw body 3, and a movable jaw body 4. Specifically, the crusher body 1 is shaped in the form of a box, its interior is formed with a hollow shape, and an opening 2 is provided on the front side thereof. The stationary jaw body 3 is disposed integrally in such a manner as to project outwardly from a lower end of the opening 2 in the crusher body 1.

The stationary jaw body 3 is formed in the shape of a fork having a three-pronged distal end, and projects forwardly longer than the distal end of the movable jaw body 4. Specifically, the stationary jaw body 3 projects forwardly of the movable jaw body 4 in a state in which the movable jaw body 4 is closed over the stationary jaw body 3. This arrangement facilitates the raking out of the pile of crushed masses W simultaneously or one by one. At that time, the length of projection is set arbitrarily in the range of about 5 to 50 cm.

Furthermore, the stationary jaw body 3 in terms of its transverse direction is formed to be wider than the movable jaw body 4. Specifically, although the width of the stationary jaw body 3 is basically formed to be identical with the width of the crusher body 1, in a case where the stationary jaw body 3 is formed to be especially wider, the width of the stationary jaw body 3 is formed to be slightly larger than that of the crusher body 1 (see FIG. 5).

Figure 14:
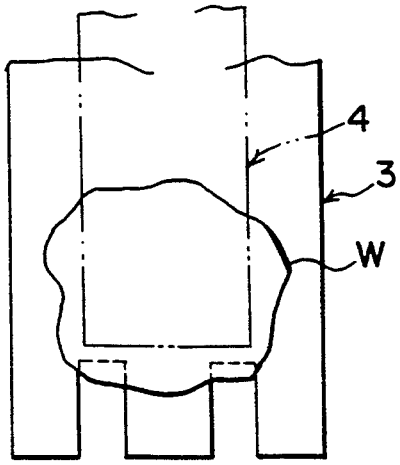
FIG. 14 is a schematic diagram illustrating the operation.

As described above, since the stationary jaw body 3 is formed to be forwardly longer or is made wider than the movable jaw body 4, and since the area of the stationary jaw body 3 is made wider than that of the movable jaw body 4, when the crushed masses W are raked out, even large crushed masses W can be raked out reliably, thereby making it possible to improve the operating efficiency (see FIG. 14).

A detachable auxiliary member B is mounted on the stationary jaw body 3. Specifically, the arrangement provided is such that when the crushed mass W is crushed, the crushed mass W is placed directly on the auxiliary member B, and is crushed by closing the movable jaw body 4. There are various embodiments in the structure in which the auxiliary member B is mounted.

Figure 7:
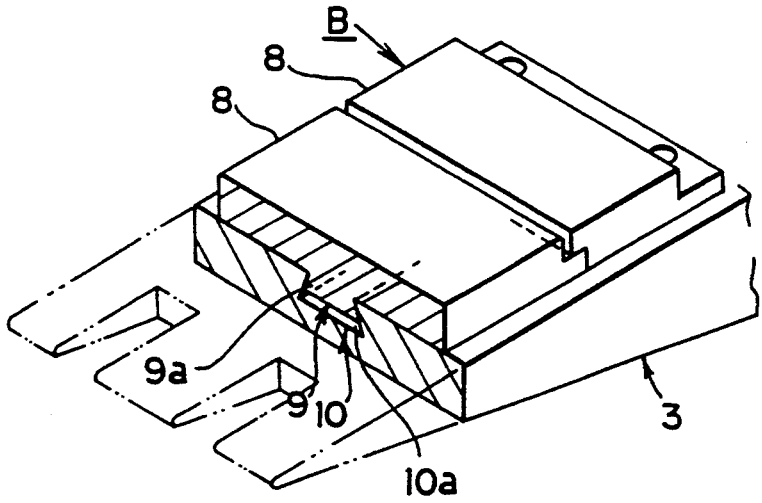
FIG. 7 is a perspective view of an essential portion of the crusher.
Figure 8:
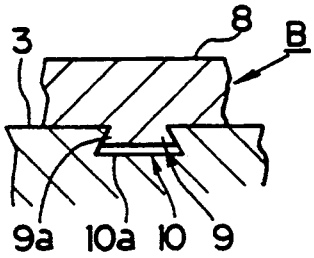
FIG. 8*a* is a cross-sectional view of an essential portion of an auxiliary member.
FIG. 8*b* is a cross-sectional view of a specific example of the auxiliary member.
Figure 8:
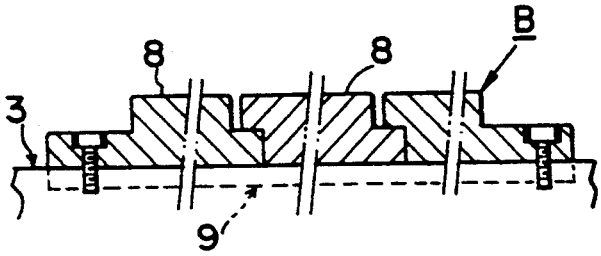
Figure 9:
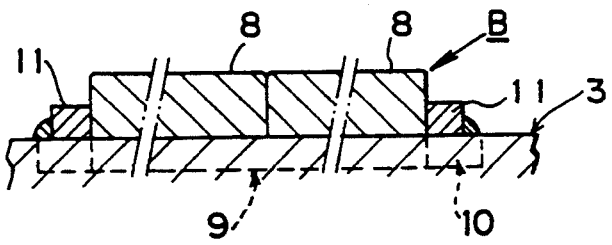
FIG. 9 is a cross-sectional view of another example of the auxiliary member.

As shown in FIG. 7 and the like, the auxiliary member B is comprised of an operating portion 8 and an attaching portion 9 which are formed integrally, and there are various embodiments of the auxiliary member B. As a first embodiment, as shown in FIGS. 7 to 9, the attaching portion 9 is formed integrally on the reverse side of the flat-shaped operating portion 8. The attaching portion is formed as a dovetail tenon 9*a*, while a mounting portion 10 is formed in the stationary jaw body 3, and the mounting portion 10 is formed as a dovetail groove 10*a*, as shown in FIGS. 7 and 8*a*. The arrangement provided is such that the dovetail tenon 9*a* of the attaching portion 9 is slidably fitted in the dovetail groove 10*a* and is retained therein.

The attaching portion 9 of the auxiliary member B is secured on the mounting portion 10 of the stationary jaw body 3, and a pair of fixing plates 11 are affixed to respective opposite ends of the operating portion 8 of the auxiliary member B (see FIG. 9).

Figure 10:
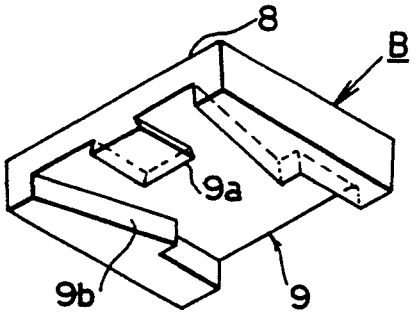
FIG. 10*a*is a perspective view of still another example the auxiliary member.
FIG. 10*b* is a perspective view of a mounting portion.
Figure 10:
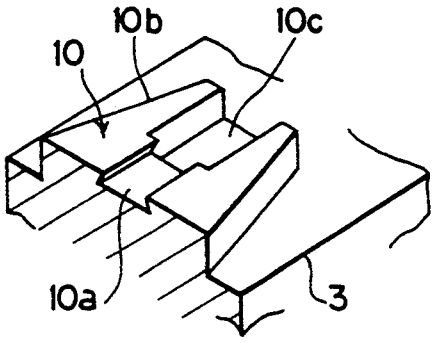
Figure 11:
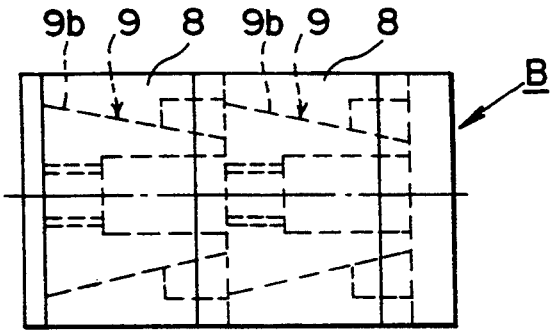
FIG. 11 is plan view of the auxiliary member.
Figure 12:
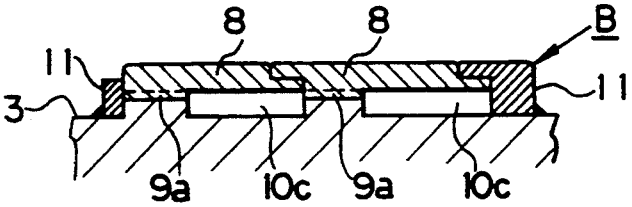
FIG. 12 is a cross-sectional view of the auxiliary member.

As a second embodiment of the auxiliary member B, as shown in FIGS. 10*a*, 10*b*, to FIG. 12, a recessed tapered fitting portion 9*b* is formed in the attaching portion 9, and the dovetail tenon 9*a* is formed in a transversely central portion of the recessed tapered fitting portion 9b. Meanwhile, the dovetail groove 10a is formed in a transversely central portion of a projecting tapered fitting portion 10b in the mounting portion 10. The recessed tapered fitting portion 9b and the projecting tapered fitting portion 10b have tapers of the same gradient, and as they are brought into contact with each other, the tapered surfaces of these members are fitted with each other.

In the above-described embodiment, a recessed portion 10c is formed in the longitudinal direction of the dovetail groove 10a in the mounting portion 10, and the dovetail tenon 9a of the attaching portion 9 can be loosely fitted in the recessed portion 10c. When the attaching portion 9 is mounted on the mounting portion 10, the dovetail tenon 9a of the attaching portion is temporarily fitted in the recessed portion 10c in the mounting portion 10. Then, while the auxiliary member B is being slid along the stationary jaw body 3, the dovetail tenon 9a is inserted into the dovetail groove 10a and is slid until the recessed tapered fitting portion 9b is brought into contact with the tapered surfaces of the projecting tapered fitting portion 10b. After the attaching portion 9 is mounted on the mounting portion 10, the attaching portion 9 is secured by means of the aforementioned fixing plates 11.

Figure 13:
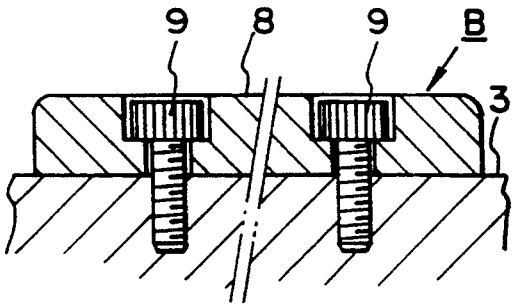
FIG. 13*a* is a cross-sectional view of a further example of the auxiliary member.
FIG. 13*b*is a cross-sectional view of a still further example of the auxiliary member.
Figure 13:
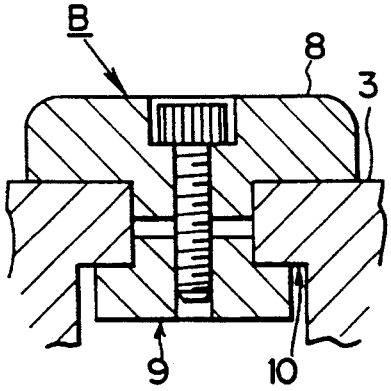

In a third embodiment of the auxiliary member B, as shown in FIG. 13a, a fixing means constituted by bolts are used for fixing the attaching portion 9 of the auxiliary member B. As the bolts are threadedly inserted into internal threads formed in the mounting portion 10 of the stationary jaw body 3 so as to fix the auxiliary member B.

In a fourth embodiment of the auxiliary member B, as shown in FIG. 13b, the mounting portion 10 is formed as an inverse T-shaped groove formed on the surface of the stationary jaw body 3. The attaching member 9 corresponding to the mounting portion 10 is formed as a separate member from the operating portion 9, and is constituted by a retaining block capable of being retained in the inverse T-shaped groove. The attaching portion 9 is secured to the operating portion 8 by means of bolts.

The auxiliary member B is mounted on the crushing-operation side of the stationary jaw body 3, i.e., the side thereof for engaging with the movable jaw body 4. However, the auxiliary member B may be mounted on the reverse side of the stationary jaw body 3, i.e., on the side thereof opposite to the crushing-operation side, as required.

Figure 15:
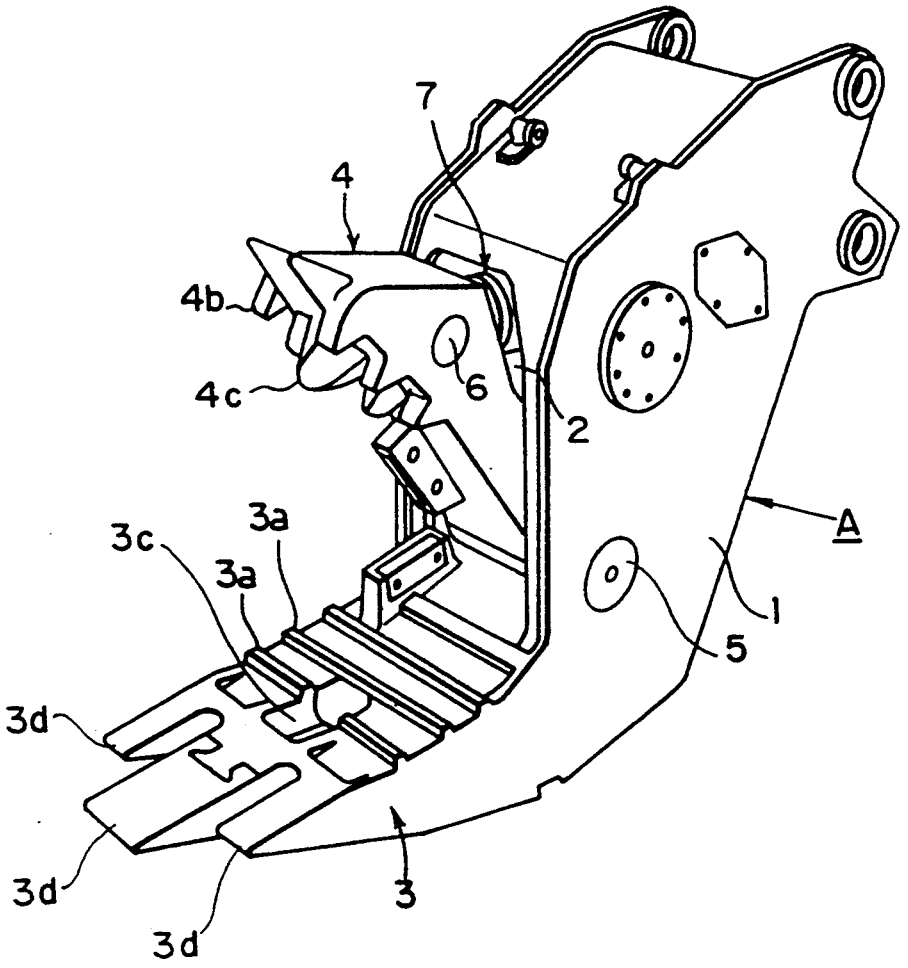
FIG. 15 is a crusher in accordance with another embodiment.
Figure 16:
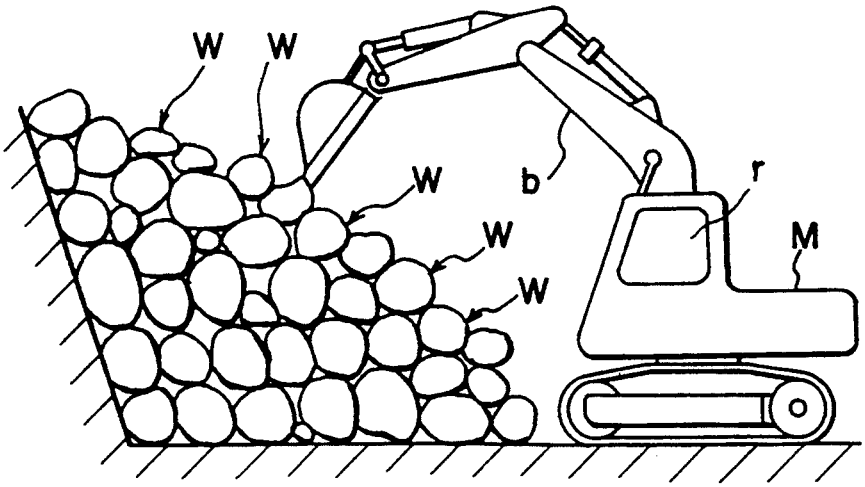
FIG. 16 PRIOR ART
FIGS. 16 and 17 are schematic diagrams illustrating the operation.
Figure 17:
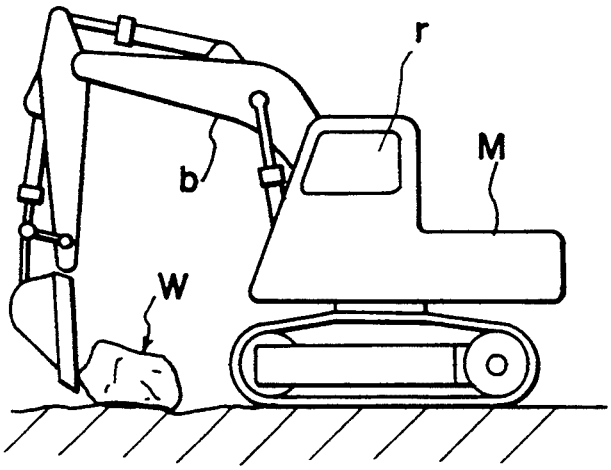
FIG. 17 PRIOR ART
Figure 18:
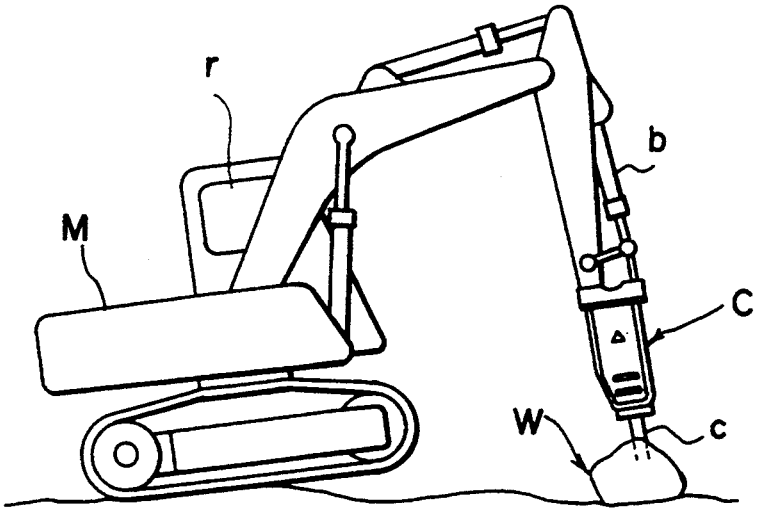
FIG. 18 PRIOR ART
FIGS. 18 and 19 are schematic diagrams illustrating the conventional art.
Figure 19:
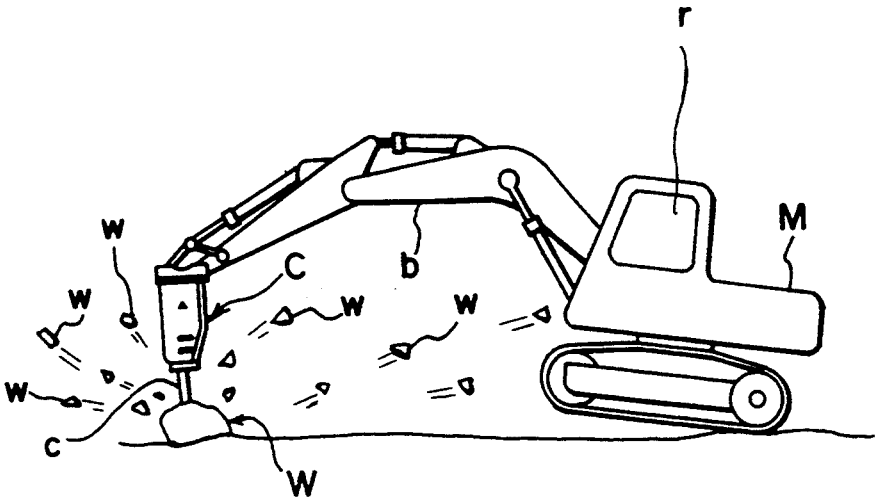
FIG. 19 PRIOR ART

As another embodiment of the crusher A, as shown in FIG. 15, projections 3a are formed on the upper surface (the surface opposing the movable jaw body 4 which will be described later) of the stationary jaw body 3 in parallel with each other in the transverse direction of the stationary jaw body 3. In addition, the movable jaw body 4 is arranged such that a proximal portion 4a (see FIG. 6) is pivotally supported by being inserted in the crusher body 1 through the aforementioned opening 2, and is opened and closed in correspondence with the stationary jaw body 3. A large blade 4c for longitudinal cracking disposed on the movable jaw body 4 can be accommodated in an accommodating portion 3c formed in a transversely central portion of the stationary jaw body 3.

Specifically, as shown in FIG. 6, the proximal portion 4a of the movable jaw body 4 is pivotally supported on a pivotal shaft 5 disposed at a lower end of the opening 2 of the crusher body 1, and is adapted to swing along a vertical plane of the stationary jaw body 3. The movable jaw body 4 has a substantially rectangular cross section, and its interior is made hollow. A distal end (the opposite side to the proximal portion 4a) of the movable jaw body 4 protrudes slightly upward, and a pivotal shaft 6 is disposed at the distal end of the movable jaw body 4. A distal end of a piston rod 7a of a hydraulic cylinder 7 for opening and closing is pivotally supported by the pivotal shaft 6, and a longitudinally intermediate portion of a cylinder body 7b of the hydraulic cylinder 7 is pivotally supported on the crusher body 1.

Two rows of blades 4b for transverse cracking are arranged on the transversely opposite sides of the movable jaw body 4 on the lower surface side thereof (on the surface opposing the stationary jaw body 3) at predetermined intervals. The aforementioned large blade 4c for longitudinal cracking is disposed at a substantially central position between these two rows of the blades 4b for transverse cracking.

In the above-described arrangement, the crusher capable of crushing by the opening and closing operation of the stationary jaw body and the movable jaw body is mounted at the distal end of the operating boom of the construction vehicle. A crushed mass of natural stone obtained in a blasting operation is crushed by the auxiliary member disposed on the stationary jaw body and the movable jaw body of the crusher. As a result, various advantages are obtained in that, firstly, the operation of crushing the crushed mass W can be performed efficiently; secondly, it is possible to provide a safe and satisfactory working environment for the operator; and thirdly, the crusher A is made durable.

A more detailed description will be given of the above-described advantages. Although in the conventional system for crushing the crushed masses W of natural stone, rock is detonated with explosives such as dynamite and crushed into a pile of crushed masses W by means of the breaker C. Then, before performing the crushing operation with the breaker C, one crushed mass W at a time must be raked out, as necessary, from the pile of crushed masses W of natural stone, and be moved to a place where the crushed mass W can be placed in a very stable condition, such as a flat ground surface. Hence, a construction vehicle exclusively used for that purpose is otherwise required in the conventional system. In the system of the present invention, however, since the crushing operation is performed by using the construction vehicle M in which the crusher A comprised of the stationary jaw body 3 disposed on the crusher body 1 and the movable jaw body 4 capable of opening and closing over the stationary jaw body 3 is mounted at the distal end of the operating boom b of the construction vehicle M. Therefore, by operating from an operator's cabin r of the construction vehicle M, the operator is capable of easily taking out an appropriate crushed mass W from the pile of crushed masses W by means of the crusher A. As a result, it becomes unnecessary to specially prepare another exclusive-use construction vehicle for the operation of taking out one crushed mass W at a time from the pile of crushed masses W.

In addition, since an appropriate crushed mass W is taken out from the pile of crushed masses W in such a manner as to be held by the stationary jaw body 3 and the movable jaw body 4, and the crushed mass W is concurrently crushed by closing the movable jaw body 4 onto the stationary jaw body 3, it is possible to perform the crushing operation very speedily. As described above, it is unnecessary to effect the conventional troublesome operation in which the crushed mass W is broken by bringing the chisel c of the breaker C into contact therewith after the crushed mass W is specially moved to a place where it can be placed stably, such as a flat ground surface, and after it is set in a stable condition. Accordingly, it is unnecessary to secure such a flat ground surface, and there is no need to spend much time in preparation for the crushing operation, thereby making it possible to improve the operational efficiency remarkably.

In the present invention, since the auxiliary member B is arranged detachably, even if deformation or the like occurs in the auxiliary member B due to repeated use, it is possible to readily cope with such a situation by merely replacing the auxiliary member B alone, thereby making it possible to substantially reduce the cost. Furthermore, since the surface of the auxiliary member B facing the movable jaw body 4 is formed with a flat surface, it is possible to obtain a greater crushing force, so that it is possible to satisfactorily realize further crushing of the crushed masses W obtained by the blasting operation.

In the conventional system, the operation of breaking the crushed masses W by means of the breaker C is performed after the crushed mass W is raked out to a stable and flat ground surface, and after it is set on the flat ground surface in a most stable state. This being the case, however, if the condition in which the crushed mass W is set becomes poor and unstable due to the vibration and impact of the breaker C, the angle at which the chisel c of the breaker C strikes against the crushed mass W deviates from an allowable range, so that the chisel c of the breaker C fails to be brought into contact with the crushed mass W properly. As a result, there have been cases where the chisel c strikes at the air, possibly damaging the breaker C by the impact exerted by itself. In the present invention, however, since the crushed mass W is held by the stationary jaw body 3 and the movable jaw body 4 and the movable jaw body 4 is gradually closed toward the stationary jaw body 3, it is possible to break the crushed mass W much more quietly than the breaker C, and less impact is exerted. Hence, the durability of the crusher A improves, and it is possible to make the breakdown of the machine less likely to occur.

In addition, since, in this system of breaking the crushed masses of natural stone, the crusher capable of effecting a crushing operation through the closing operation of the movable jaw body with respect to the stationary jaw body is disposed at a distal end of the operating boom of a construction vehicle, and the width of the stationary jaw body is expanded appropriately, it is possible to obtain the following advantages: First of all, it is possible to rake out an appropriate crushed mass W quite easily from the pile of crushed masses W. Secondly, when the crushed mass W is broken, it is possible to restrict the range of scattering of the small masses w to a very small range.

That is, since the width of the stationary jaw body 3 of the crusher A is made large, the stationary jaw body makes it possible to break a very large crushed mass W, and this stationary jaw body 3 is very advantageous when an appropriate crushed mass W is raked out from the pile of crushed masses W. In addition, there is a further advantage in that it is possible to efficiently effect the raking of the small masses w when the crushed mass W is broken, and the dig up of a crushed mass W to be newly broken.

In the operation of breaking the crushed mass W by means of the breaker C as in the conventional system, since the vehement percussion of the chisel c is utilized, the operation is very dangerous to the operator when the crushed mass W is broken and the small masses w are scattered to a wide range. In addition, the scattering small masses w can strike against the construction vehicle M, possibly causing damage to the construction vehicle M as well. In the present invention, however, since the crushed mass W is held by the stationary jaw body 3 and the movable jaw body 4 and the movable jaw body 4 is slowly closed toward the stationary jaw body 3, it is possible to restrict the range of scattering of the small masses to a very small range, thereby making it possible to provide a safe working environment.

What is claimed is:

1. A crusher, comprising a stationary jaw body and a movable jaw body disposed at a distal end of an operating boom of a construction vehicle so as to break crushed masses of stone through an opening and closing operation of the movable jaw body with respect to the stationary jaw body; and an auxiliary member disposed on said stationary jaw body in face-to-face relation with said movable jaw body, wherein a surface of said auxiliary member opposing said movable jaw body is formed with a flat surface, said auxiliary member being detachably disposed with respect to said stationary jaw body, and wherein said auxiliary member includes a plurality of flat members arranged in a row on said stationary jaw body.

2. A crusher according to claim 1, wherein said auxiliary member is slidably fitted with respect to said stationary jaw body.

3. A crusher according to claim 2, wherein said auxiliary member is attachable to said stationary jaw body through engagement between a dovetail tenon formed on said auxiliary member and a dovetail groove formed in said stationary jaw body.

4. A crusher according to claim 1 wherein said auxiliary member is attached to said stationary jaw body with bolts.

5. A crusher according to claim 1, wherein a plurality of blades are formed on said movable jaw body for imparting a breaking force to the crushed mass in cooperation with said auxiliary member.

6. A crusher according to claim 1, wherein said row extends in the longitudinal direction of said stationary jaw body.

7. A crusher, comprising a stationary jaw body and a movable jaw body disposed at a distal end of an operating boom of a construction vehicle so as to break crushed masses of stone through an opening and closing operation of the movable jaw body with respect to the stationary jaw body; and an auxiliary member disposed on said stationary jaw body in face-to-face relation with said movable jaw body, said stationary jaw body being disposed to project a distance greater than the distal end of said movable jaw body, wherein said auxiliary member is constituted by a plurality of flat members arranged in a row on said stationary jaw body.

8. A crusher according to claim 7, wherein said stationary jaw body projects a distance greater than approximately 5 to 30 cm longer than the distal end of said movable jaw body.

9. A crusher according to claim 7, wherein a distal end of said stationary jaw body is formed in the shape of a three-pronged fork, a central prong thereof projecting longer than remaining prongs.

10. A crusher according to claim 7, wherein said auxiliary member is detachably disposed detachably with respect to said stationary jaw body.

11. A crusher according to claim 7, wherein said auxiliary member is slidably fitted with respect to said stationary jaw body.

12. A crusher according to claim 7 wherein said auxiliary member is attachable to said stationary jaw body through engagement between a dovetail tenon formed on said auxiliary member and a dovetail groove formed in said stationary jaw body.

13. A crusher according to claim 7, wherein said auxiliary member is attached to said stationary jaw body with bolts.

14. A crusher according to claim 7, wherein a plurality of blades are formed on said movable jaw body for imparting a breaking force to the crushed mass in cooperation with said auxiliary member.

15. A crusher according to claim 7, wherein the width of said stationary jaw body is larger than the width of said movable jaw body.

16. A crusher according to claim 7, wherein said row extends in the longitudinal direction of said stationary jaw body.

* * * * *